United States Patent [19]

Anderson

[11] 4,413,437

[45] Nov. 8, 1983

[54] CARTRIDGE MAGAZINE

[76] Inventor: Robert A. Anderson, 19009 Laurel Park Rd., Sp. 75, Dominguez Hills, Calif. 90220

[21] Appl. No.: 273,869

[22] Filed: Jun. 15, 1981

[51] Int. Cl.[3] ..... F41C 25/02

[52] U.S. Cl. ..... 42/50

[58] Field of Search ..... 42/50, 7

[56] References Cited

U.S. PATENT DOCUMENTS

| | | | |
|---|---|---|---|
| 1,245,499 | 11/1917 | Orme | 42/50 |
| 2,828,568 | 4/1958 | Sakewitz | 42/50 |
| 3,222,810 | 12/1965 | Musgrave | 42/50 |
| 3,440,751 | 4/1969 | Fremont | 42/50 |
| 3,453,762 | 7/1969 | Fremont | 42/50 |
| 4,107,862 | 8/1978 | Sofinowski | 42/50 |
| 4,139,959 | 2/1979 | Howard et al. | 42/50 |

FOREIGN PATENT DOCUMENTS

| | | | |
|---|---|---|---|
| 1269918 | 6/1968 | Fed. Rep. of Germany | 42/50 |

*Primary Examiner*—Charles T. Jordan

*Attorney, Agent, or Firm*—Singer & Singer

[57] ABSTRACT

An improved cartridge magazine constructed of high impact nylon resin and in which a spring urged follower pushes cartridges into a rifle into which the casing is inserted. The follower is attached to the spring which prevents fore and aft movement of the follower and the spring is curved to physically contact the bottommost portion of the follower to prevent the follower from pivoting about the spring contact. A removable floor plate is removably attached to the casing by means of a pair of resilient latches. The floor plate is symmetrical and has no preferred orientation, thereby simplifying loading of the cartridges.

3 Claims, 7 Drawing Figures

CARTRIDGE MAGAZINE

This invention relates to an improved cartridge magazine and more specifically to a magazine for supplying cartridges to a rifle.

In the prior art it is well known to use a magazine holding a plurality of cartridges for use with a rifle to thereby simplify the feeding of cartridges into the rifle, either in a single shot or automatic mode.

A typical magazine can be constructed to hold from 5, 10, 20, 30 or even 40 cartridges, thereby allowing the user to continuously use and fire his rifle without the necessity of reloading or inserting new cartridges into the rifle.

In order to satisfy the functional requirement of the user, the magazine must be easy to use and load and be free of any tendency to jam, since it will be appreciated that any jam, whether it be simple or complex, renders the rifle useless, thereby rendering the user helpless either as a mercenary or as a hunter.

A cartridge magazine to be successful must be strong, relatively indestructible, and capable of being taken apart and loaded in the field with a minimum of instruction and usually under adverse and hostile conditions.

The prior art has recognized the advantages of using magazines in connection with rifles as exemplified by Fremont U.S. Pat. No. 3,440,751, Fremont U.S. Pat. No. 3,453,762, and Fremont U.S. Pat. No. 3,619,929.

These patents disclose the concept of substantially rectangular magazines having a base plate, a spring and a follower adapted to push cartridges into the operating chamber of the rifle.

Magazine cartridges of the type being described are subject to continual abuse in the field since the magazines are usually thrown away after the cartridges are expended and at some later time they are reclaimed, reloaded and again used in the field. Damage to the magazines and misuse by unskilled persons cause problems in loading the magazines, resulting in malfunction of the parts and jamming problems associated with either improperly assembled magazines or magazines rendered defective by misuse.

U.S. Pat. No. 4,139,959, issued to Howard and Harvey is considered the closest art to the present invention. The Howard patent discloses a base plate removably attached to the casing and supporting a coiled spring at one end which is connected to a follower at the other end.

While the Howard patent represents a significant advance in the art, there are problems of assembly in the field and a tendency to jam, which problems have been solved by the present invention.

In the present invention all parts, other than the spring, are now constructed of high impact plastic known as Dupont "Super Tough" Zytel® nylon resin, formula 80G33BK104. This resin has not previously been used for the manufacture of casings and it has proven to be extremely strong, resistant to damage, and retains its shape under the most adverse conditions. Casings have been subjected to torture tests which include dropping from high heights, repeated blows with hammers and rocks and being driven over in the field by automobiles and trucks without affecting the functional usefulness of the casing itself.

Present day techniques primarily use aluminum and steel in the construction of the casing material. The most critical part of the casing is in the uppermost portion where the curved fingers allow only a single cartridge to be ejected at a time. Deforming theses fingers, or bending them, interferes with the operation and feeding of ammuntion from the casing to the rifle and is a constant source of jamming. Steel and aluminum casings when subjected to abuse sustain deformations and bending that are retained by the casing material.

In other words, dropping or beating an aluminum or steel casing will invariably cause a dent that will interfere with the movement of the follower or the feeding of the ammunition, whereas the casing is otherwise undamaged but certainly unusable. High impact plastic material casings made from Zytel® nylon resin withstand deformations and abuse to a greater extent than aluminum or steel, thereby leaving the nylon resin casing still usable after the same abuse that would render an aluminum or steel casing unusable for the intended purpose.

Assembly of the casing is facilitated by constructing the base portion with a pair of resilient locking fingers that each lock into a suitable opening in the bottommost portion of the casing. The base portion is symmetrical having no preferred orientation, thereby allowing the user to reassemble the casing in the field under adverse conditions and without regard to a preferred direction since the base member is otherwise reversible.

The prior art devices as exemplified by the patents cited either have a preferred orientation requiring the base member to be inserted in a given direction thereby making field assembly difficult, or they have an external locking device in addition to the base member which physially attaches to the bottommost portion of the casing to lock the base member in place.

In either situation, assembly of the prior art devices in the field is rendered more difficult for the novice and even for the experienced operator as opposed to the present invention which contains a minimum of parts that can be assembled in the dark without having a preferred orientation in assembly.

The action of the follower in urging the cartridges into the rifle and without jamming has been improved by utilizing a pair of fingers on each side of the follower adapted to ride on guiding ribs within the casing, thereby eliminating any tendency of the follower to twist and jam in a lateral direction.

The follower is also physically attached to the uppermost portion of the spring to thereby prevent the follower from moving in a fore and aft direction, thereby preventing any tendency of the follower to jam in a fore and aft direction.

In the prior art devices the follower has been allowed to pivot about the spring on the theory that the pivoting action helped urge the cartridges into the rifle.

In the present invention the spring is formed substantially in the form of a rectangle and adjusted so as to bear against the bottommost portion of the follower in both the forward and rearward position about the attachment point, thereby giving substantial support for the follower and preventing any pivoting of the follower about the spring attachment point. In the event that any rounds resist the upward movement, any tendency of the follower to bend or twist is immediately resisted by the full action of the complete spring whereas in the prior art devices the follower would pivot without any spring action before the spring would again urge the follower in an upward direction, thereby allowing a jam to develop which in the present invention is immediately cleared by the full use of the complete spring action.

In the present invention there is described a substantially rectangular shaped casing having a removable base portion at the bottommost portion and a coiled spring located within said casing and supported at one end by said removable base portion.

The spring is formed to physically contact the follower in force and aft portions of the spring attachment point, thereby preventing the follower from pivoting about the spring and allowing the full spring at all times to urge cartridges in an upward direction without jamming.

Further objects and advantages of the present invention will be made more apparent by referring now to the accompanying drawings wherein.

Figure 1:
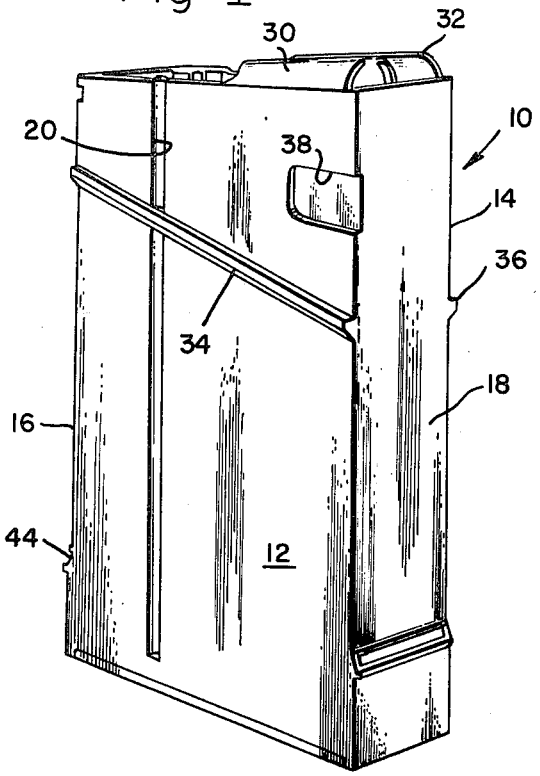
FIG. 1 is a perspective view of the magazine.

Referring now to FIG. 1, there is shown casing 10 constructed according to the teachings of the present invention. The casing 10 was designed for use primarily with the H&K-91 rifle which is otherwise similar to the military version known as the G-3. The construction details described for the H&K-91 casing is applicable to other casings designed for other rifles.

The casing 10 is constructed of Zytel® nylon resin which is a high impact plastic material sold by Dupont under the trade name "Super Tough." This material withstands enormous abuse in the field and does not deform under usual or abnormal usage and hence retains its shape thereby allowing the casing to be reused as a functional casing when other casings made of steel and aluminum have been misshaped and are rendered useless for their intended operation.

The casing 10 is substantially rectangular in shape to accommodate the maximum number of cartridges and contains oppositely disposed flat side walls 12 and 14 and oppositely disposed flat end walls 16 and 18.

The external dimension of the casing 10 is sized to fit precisely within the opening of the rifle so as to provide a snug fit. This allows the maximum thickness of material to be used in order to supply a casing that is rigid and strong for the intended purpose.

A pair of longitudinal grooves 20 and 22 (not illustrated) are located on the flat sides 12 and 14, respectively. The grooves 20 and 22 project within the casing and provide the dual function of stiffening the longitudinal axis of the casing 10 and also provide guiding action for the follower 24 which is more fully illustrated in FIGS. 2, 6 and 7. The follower 24 contains a pair of notches 26 and 28 more fully illustrated in FIGS. 5 and 6 that are adapted to ride upon grooves 20 and 22 for alignment purposes.

Referring again to FIG. 1, the uppermost portion of the casing 10 contains curved lips 30 and 32 which are adapted to hold the cartridges in place and in a manner that is well known in the art.

Located on wall 12 is rib 34 and in a similar fashion rib 36 is located on side wall 14 in a corresponding position and located to abut against a corresponding portion on the rifle to limit the travel of the magazine when inserted within the rifle itself. The magazine is locked in place by means of an opening 38 located on wall 12 which is adapted to receive a locking member located on the rifle. The opening 38 is dictated by the needs of the rifle and is constructed in a manner that is well known in the art today. U.S. Pat. No. 3,453,762 illustrates the use of limiting ribs similar to ribs 34 and 36 and openings for locking the magazine as described herein.

A transverse opening 40 is located on the end wall 18 and provides a shoulder for the insertion of the base member 42 more fully illustrated in FIGS. 2, 3, 4 and 7. A similar opening 44 is located on end wall 16 and for the same purpose.

Figure 2:
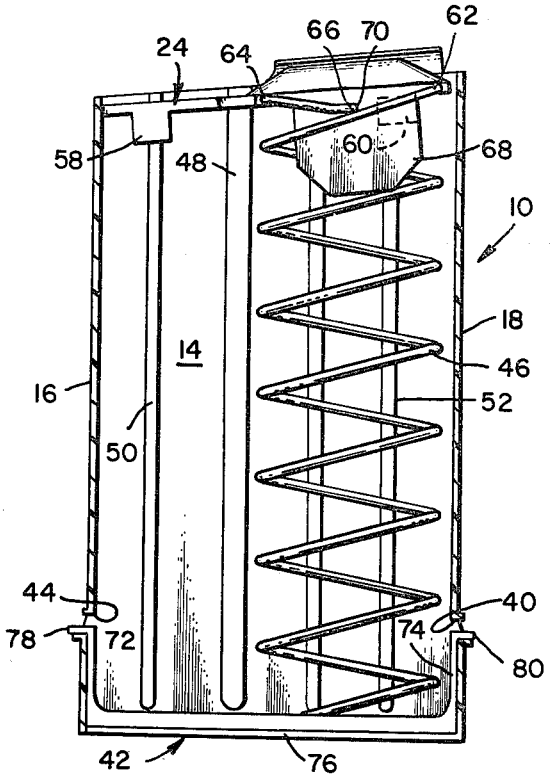
FIG. 2 is a cross-sectional view of the magazine showing the bottom portion, the spring and the follower in place.

Referring now to FIG. 2, there is shown a cross-section of the casing 10 illustrated in FIG. 1.

FIG. 2 illustrates a casing 10 with the base member 42 inserted and providing the support for a substantially rectangular coiled spring 46 attached to and urging the follower 24 into an upward position. The FIG. 2 shows all cartridges expended and the follower 24 abutting against the curved lips 30 and 32, thereby preventing further vertical travel of the follower.

The grooves 20 and 22 illustrated in FIG. 1 project within the inside wall of the casing and form ribs such as rib 48 on the inside wall 14. The rib formed on the inside wall 12 from groove 20 is not illustrated. The ribs 48 provide lateral support for reinforcing the casing and also act as guide rails for the notches 26 and 28 located on the follower 24 as the follower travels in a vertical up and down direction.

A plurality of smaller ribs 50 and 52 are also located on the inside of wall 14 which also act as stiffening members for the wall 14 in the longitudinal direction and as guides for fingers 54 and 56 located on one side of the follower 24. In a similar manner fingers 58 and 60 are located on the other side of the follower 24 and are adapted to move along ribs on the inside of face plate 12 in the same fashion that fingers 54 and 56 ride along ribs 50 and 52.

The spring 46 is formed in the shape of a rectangle in order to obtain the maximum amount of spring action within the casing 10. The top portion of the spring 46 forms a loop that is in direct contact with the bottommost portion of the follower 24 so that loop portions 62 through 64 fully contact the bottommost portion of the follower 24 and provide rigid support between the follower and the spring. The end portion of the spring 46 as at 66 is formed in a downward position and is adapted to enter a hole in a finger member 68 that is attached to the bottommost central portion of the follower 24. Finger 68 is located to the rear of center of the follower 24 and contains an opening 70 that is located approximately one-third the distance from rearward dimension of the follower.

The connection between the end of the spring 66 located within the hole 70 of finger 68 insures that the follower 24 will not move in a fore and aft position relative to the spring. If there is any movement resulting from dimensional variations of the inside dimension of the casing 10, then the spring 46 and the follower 24 will move as a unit. In addition, the loop of spring 46 in contacting the follower along edge 62 and 64 ensures that the follower 24 will at all times be supported fully by the spring and that the follower will not be allowed to pivot relative to the spring attachment point as at 66 and 70.

The base member 42 comprises a pair of flexible arms 72 and 74 located at each end of a substantially flat plate 76. Each arm 72 and 74 contains a shoulder portion 78 and 80 adapted to be located within openings 44 and 40 on end plates 16 and 18, respectively. The base member 42 is symmetrical in construction and hence shoulder 80 can be inserted in opening 44 and similarly shoulder 78 may be inserted in opening 40. In other words, base member 42 is completely reversible and has no preferred orientation in assembly or disasembly. The reversibility of the base member 42 is more fully appreciated by reviewing FIGS. 3 and 4.

Figure 3:
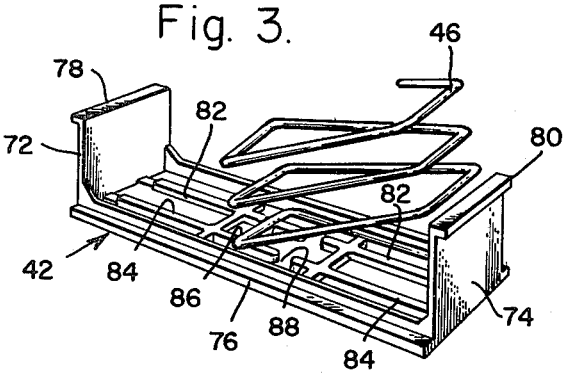
FIG. 3 is a perspective view of the base member holding the spring in a first position.
Figure 4:
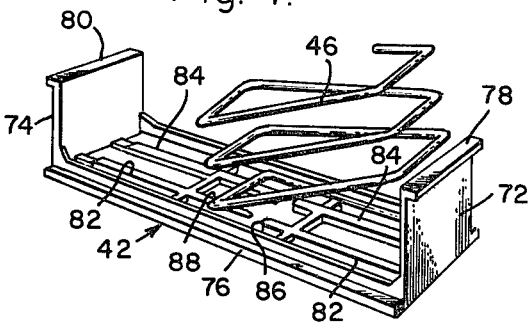
FIG. 4 is a perspective view of the base member in a second position supporting the spring.

Referring now to FIGS. 3 and 4, there is shown a plurality of ribs 82 and 84 that extend longitudinally along plate 76. Longitudinal ribs 82 and 84 contain a transverse break at 86 and at 88 in order to allow the bottommost coil of spring 46 to rest against the plate 76 of the base member 42.

A review of FIGS. 3 and 4 will show that with the base member 42 in a first position as shown in FIG. 3, that one end of the bottommost coil of spring 46 fits in transverse opening 86 whereas reversing the base member 42 as shown in FIG. 4 allows the transverse member of coil 46 to fit within opening 88.

In this fashion the base member 42 is completely reversible and will accept the spring 46 in either the first position as shown in FIG. 3 or the reverse position as shown in FIG. 4. In either position the base member is then insertable within the casing so as to latch shoulders 78 and 80 within the openings of 40 and 44 in the end plates of 18 and 16, respectively.

Figure 5:
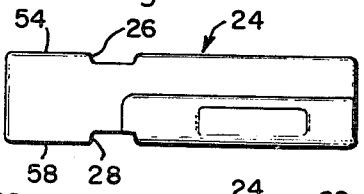
FIG. 5 is a top view of the follower.

FIG. 5 illustrates a top view of the follower 24 showing the position of the fingers 54 and 56 on one side and fingers 58 and 60 on the opposite side. The position of grooves 26 and 28 that ride upon ribs 48 located within the casing on sides 14 and 12, respectively, are also illustrated.

Figure 6:
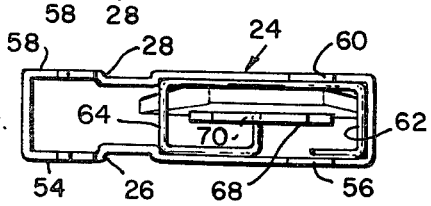
FIG. 6 is a bottom view of the follower illustrating the spring attachment.

Referring now to FIG. 6, there is shown a bottom view of the follower 24 and more fully illustrating how the topmost coil of spring 46 physically contacts the bottommost portion of the follower 24. Coil 62 being in direct contact with the rearmost portion of the follower 24 and coil portion 64 being in contact with the forward portion of member 24 thereby fixedly holding the follower in position relative to the spring and preventing any fore and aft movement of the follower relative to the spring.

Figure 7:
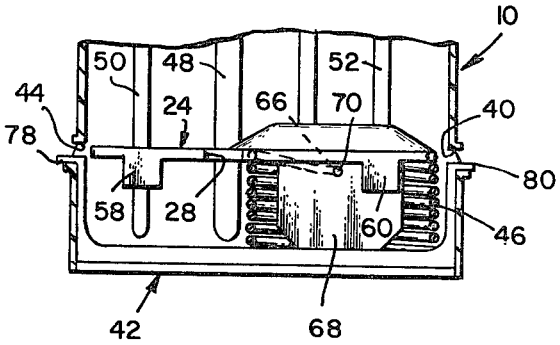
FIG. 7 is a partial cross-section of the bottommost portion of the magazine showing the follower contacting the base member thereby preventing overloading of the magazine.

Referring now to FIG. 7, there is shown a cross-sectional view of the bottommost portion of the casing 10 and with the casing completely loaded with cartridges. In the position illustrated in FIG. 7 the finger 68 associated with the follower 24 abuts against the base member 42 thereby preventing additional ammunition from being inserted into the casing 10, thereby preventing overloading of the casing.

I claim:

1. A cartridge magazine comprising:

a substantially rectangular shaped casing having a removable base portion at the bottommost portion, a coiled spring located within said casing and supported at one end by said removable base portion, and a follower attached to the other end of said spring to prevent fore and aft motion of the follower, said spring formed to physically contact the follower in the fore and aft portions of the spring attachment point thereby preventing the follower from pivoting about the spring and allowing the full spring at all times to urge cartridges in an upward direction without jamming, said follower has a tongue portion with an opening located below the bottommost portion of the follower and the end of the spring is lower than the highest coiled loop and is adapted to be inserted in said opening thereby attaching said follower to said spring and preventing fore and aft motion of the follower.

2. A cartridge magazine comprising:

a substantially rectangular shaped casing having a removable base portion at the bottomost portion, a coiled spring located within said casing and supported at one end by said removable base portion, said removable base portion has longitudinal and lateral reinforcing ribs and in which said ribs are cut to allow contact between said spring and said base portion in either the forward or reverse position, and a follower attached to the other end of said spring to prevent fore and aft motion of the follower, said spring formed to physically contact the follower in the fore and aft portions of the spring attachment point thereby preventing the follower from pivoting about the spring and allowing the full spring at all times to urge cartridges in an upward direction without jamming.

3. A magazine according to claim 2 in which the bottommost coil of said spring is in direct contact with the base member at all times and is physically located within said transverse notches located in the ribs on said base member.

* * * * *